US009821336B2

(12) United States Patent
Kellokoski et al.

(10) Patent No.: US 9,821,336 B2
(45) Date of Patent: Nov. 21, 2017

(54) MULTI FUNCTION PAINTER'S TOOL BOX

(71) Applicants: Timo Kellokoski, Oakville (CA); Katja Kellokoski, Oakville (CA)

(72) Inventors: Timo Kellokoski, Oakville (CA); Katja Kellokoski, Oakville (CA)

( * ) Notice: Subject to any disclaimer, the term of this patent is extended or adjusted under 35 U.S.C. 154(b) by 25 days.

(21) Appl. No.: 14/545,147

(22) Filed: Mar. 31, 2015

(65) Prior Publication Data

US 2015/0283576 A1 Oct. 8, 2015

Related U.S. Application Data

(60) Provisional application No. 61/975,002, filed on Apr. 4, 2014.

(51) Int. Cl.

| | |
|---|---|
| ***A47L 23/28*** | (2006.01) |
| ***B05C 17/02*** | (2006.01) |
| ***A46B 17/06*** | (2006.01) |
| ***B44D 3/12*** | (2006.01) |
| ***B44D 3/00*** | (2006.01) |

(52) U.S. Cl.

CPC ..... *B05C 17/0245* (2013.01); *A46B 17/06* (2013.01); *B44D 3/006* (2013.01); *B44D 3/125* (2013.01); *A46B 2200/202* (2013.01)

(58) Field of Classification Search

CPC .... B05C 17/0245; B44D 3/006; B44D 3/125; B44D 3/04; A46B 17/06

USPC ..... 203/372–375, 472–473; 15/258

See application file for complete search history.

(56) References Cited

U.S. PATENT DOCUMENTS

| | | | | |
|---|---|---|---|---|
| 3,688,785 A * | 9/1972 | Stevens | B44D 3/006 134/138 |
| 7,866,329 B2 * | 1/2011 | Bates | B44D 3/006 134/138 |
| 2008/0315737 A1 * | 12/2008 | Hammond | B25H 3/023 312/242 |
| 2013/0233735 A1 * | 9/2013 | Hurley | B44D 3/125 206/209 |
| 2015/0068561 A1 * | 3/2015 | McClish | B44D 3/006 134/110 |

* cited by examiner

*Primary Examiner* — Kristen Matter

(57) ABSTRACT

A multi function painter's tool box apparatus enabling a user to protect, store and transport various painting tools; clean and spin dry various paint roller covers from water soluble paints and/or stains by using free a hand method with a garden hose or other flexible hose and household water pressure, by generating a jet spray with a nozzle or restricting the flow otherwise, through the rectangular washing slot and generating a high speed whirling motion to the roller; clean paintbrushes from water soluble paints and/or stains, using this single apparatus. The apparatus includes a vertically oriented box with door, a universal paint roller holder assembly, a paintbrush cleaning surface and various holders for the painting tools. It also has a rectangular washing slot on top with a splashguard and drain holes on the bottom. It has a carrying handle on the top and legs on the bottom.

12 Claims, 12 Drawing Sheets

MULTI FUNCTION PAINTER'S TOOL BOX

PRIORITY INFORMATION

This application is a nonprovisional of, and claims priority from, U.S. Provisional Patent Application Ser. No. 61/975,002, filed Apr. 4, 2014, the contents of which are incorporated herein by reference in their entirety.

BACKGROUND OF THE INVENTION

1. Field of the Invention

This invention relates generally to methods and apparatus to multi function use. More particularly, this invention relates to a mess free, environmentally friendly, free hand paint roller cover cleaning and spin drying method, paintbrush cleaning method and apparatus for multi function use in safely storing, transporting, cleaning and spin drying paint roller covers and/or paintbrushes.

2. Discussion of the Background

Various approaches for cleaning roller pads and paintbrushes have been attempted. Some of these are represented, for instance, in U.S. Pat. No. 8,973,592 B2, U.S. Pat. No. 8,985,125 B2, U.S. Pat. No. 8,813,767 B2, U.S. Pat. No. 8,672,821 B1, U.S. Pat. No. 6,450,185 B1, U.S. Pat. No. 6,408,862 B1, U.S. Pat. Nos. 5,050,626, 5,505,220, 5,005,598, 5,363,869, 4,294,272 and 4,130,124. However, each of these attempts has suffered from one or more drawbacks and has therefore failed to provide an adequate solution to the industry's needs. Many of the previous attempts have problems such as, too complicated to use, too expensive to manufacture, lack of durability, ineffective, incomplete results, messy, leave paint roller cover wet, just to name a few.

There is a high interest in devices to clean paint roller covers because, cleaning by hand under the running water is ineffective and it takes a lots of time and water. It is hard to get all the paint residue out of the paint roller cover which ruins it after its drying out. Disposing the paint roller cover after each use is not environmentally friendly solution either.

BRIEF SUMMARY OF THE INVENTION

Multi function painter's tool box provides a solution for many common problems that hobbyists and professional painters are facing frequently. This multi function tool box is designed to help the painters complete their tasks more efficiently.

Many professions have tool boxes designed for their special needs. However, painters never have had the same privilege to protect, store and transport their professional tools and prevent them from damage during those occasions.

Besides these protecting, storing and transporting capabilities, this apparatus has some special features that allow to clean the paint roller covers and paintbrushes in a controlled environment quickly and effectively, be environmentally friendly by using a small amount of water and do the cleaning process without making a mess.

Besides the cleaning capability of this invention, the paint roller cover comes out dry after the cleaning process and it is ready to use immediately.

DETAILED SUMMARY OF THE INVENTION

The scope of this invention was to create a multi function painter's tool box that allow users to protect, store and transport their professional tools and prevent them from damage during those occasions. Besides these important capabilities, this invention provides some additional key features that allow users to clean and spin dry their paint roller covers and clean their paintbrushes in a controlled environment.

When it comes to the paint roller cover cleaning, the principles of this invention overcome the problems associated with the various prior approaches. In contrast of this invention, most of the various prior approaches are single use cleaning tools, too technical and too expensive to manufacture. In one embodiment of the present invention, this simple multi function painter's tool box allow paint roller covers to be cleaned and spin dried using, simple, free hand garden hose method. It enables the user to clean roller covers in various sizes and lengths, from 114 mm trim rollers to 240 mm standard rollers.

In addition, the apparatus includes a special paintbrush cleaning surface. This slightly bowl shaped cleaning surface allows the user to clean various sizes of paintbrushes with bristle spans from 25 mm to 125 mm quickly and effectively.

The more specifically, this apparatus includes a vertically oriented box with a door on one side to access the box. It has a universal paint roller handle attachment mechanism, roller cover holders, paintbrush holders and paint roller extension pole holders. It also has a rectangular washing slot on top comprising a splashguard and drain holes on the bottom. It has a carrying handle on the top and legs on the bottom.

The discharge holes on the bottom allow the cleaning water and paint residue to be dispensed out of the tool box into designated disposal area. Four legs on the bottom of the housing of the tool box position the tool box above the supporting surface allowing the cleaning water and paint residue to be discharged from the tool box through the discharge holes more easily. Two of the four legs are placed in the outer bottom corners of the housing and two of them are placed in the outer corners of the door. The legs on bottom of the door provide stability to the vertical tool box when the door is in open position.

Roller cover holders, paintbrush holders and paint roller extension pole holders are designed to prevent damage by keep the painting tools in place during storage and transportation.

A universal paint roller handle attachment mechanism is provided to receive and retain a paint roller handle in a desired position within the apparatus where the paint roller cover can be cleaned and spin dried from water soluble paints and/or stains.

The method of this invention clean and spin dry various paint roller covers from water soluble paints and/or stains by using a garden hose or other flexible hose and household water pressure and generating a jet spray with a nozzle or restricting the flow otherwise and creating a jet spray, through the rectangular washing slot and generating a whirling motion to the roller using a free hand method, directing a jet stream spray through the rectangular washing slot on top of the box to a visible half of the paint roller through the washing slot and moving it slowly from end to end of the paint roller cover and the high speed whirling motion is forcing the remaining paint in the paint roller cover to the outer surface where it is diluted by water and washed away quickly and effectively.

Sudden stop at the end of the cleaning leaving the paint roller cover dry and it is immediately ready to use.

The housing also comprises a slightly bowl shaped surface to clean the various size paintbrushes when the housing is turned horizontally and filled with water up to the maximum level allowed by the strategically positioned discharging holes and the rectangular washing slot. Slightly bowl shaped paintbrush cleaning surface is directing the standing water in the housing to the center of the paintbrush when bending bristles to a same direction and vigorously pressing against the cleaning surface under the water. At the end of the cleaning procedure the clean running water is directed to the paintbrush and cleaning surface to rinse of the remaining paint residue from the paintbrush.

BRIEF DESCRIPTION OF DRAWINGS

The foregoing and additional objects and advantages of the present invention will become more readily apparent through the following detailed description, made with reference to the accompanying drawings, in which.

DETAILED DESCRIPTION OF THE INVENTION

According to various principles of the present invention, a multi function painter's tool box can be provided to protect, store and transport various painting tools and clean and spin dry paint roller covers and clean paintbrushes from water soluble paints and/or stains. Numerous embodiments and configurations of the present invention are possible without departing from the core principles of the present invention, each of which will become more apparent through the following detailed description of preferred embodiments.

Figure 1:
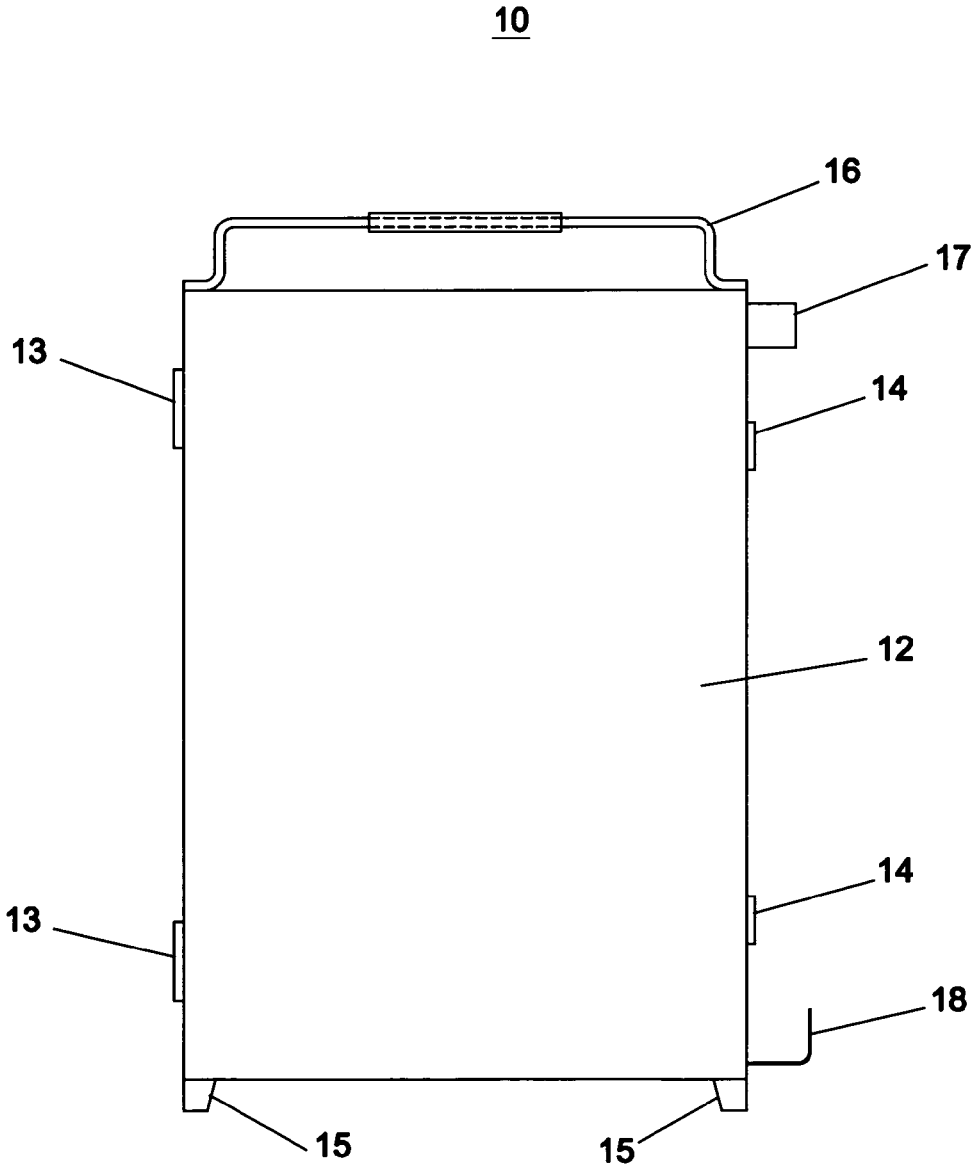
FIG. 1 is a schematic front view of the tool box.

FIG. 1 illustrates a multi function painter's tool box 10 according to an embodiment of a subject matter disclosed. As illustrated, in this front view, the multi function painter's tool box 10 includes a vertical oriented housing 11 having a door 12 in front to access the tool box 10. The door 12 is attached to the housing 11 with two hinges 13 on the left side of the door 10 allowing the door 10 open to the left. The door 10 has two latches 14 on the right side of the door 10, one part of the latch 14 attached to the housing 11 and another part attached to the door 12, holding the door 12 closed when storing, transporting, cleaning and spin drying various painting tools. Four legs 15 are oriented in each corner of the tool box 10 elevating the housing 12 off the surface allowing discharging water to escape from the tool box 10 through the discharge holes 21. Carrying handle 16 on top is provided to carry the tool box 10. Paint roller extension pole holder clip 17 is placed on top of the right side of the housing 11. The bottom part of the extension pole holder embodiment include a resting holder bracket 18 which is placed on bottom of the right side of the housing 12.

Figure 2:
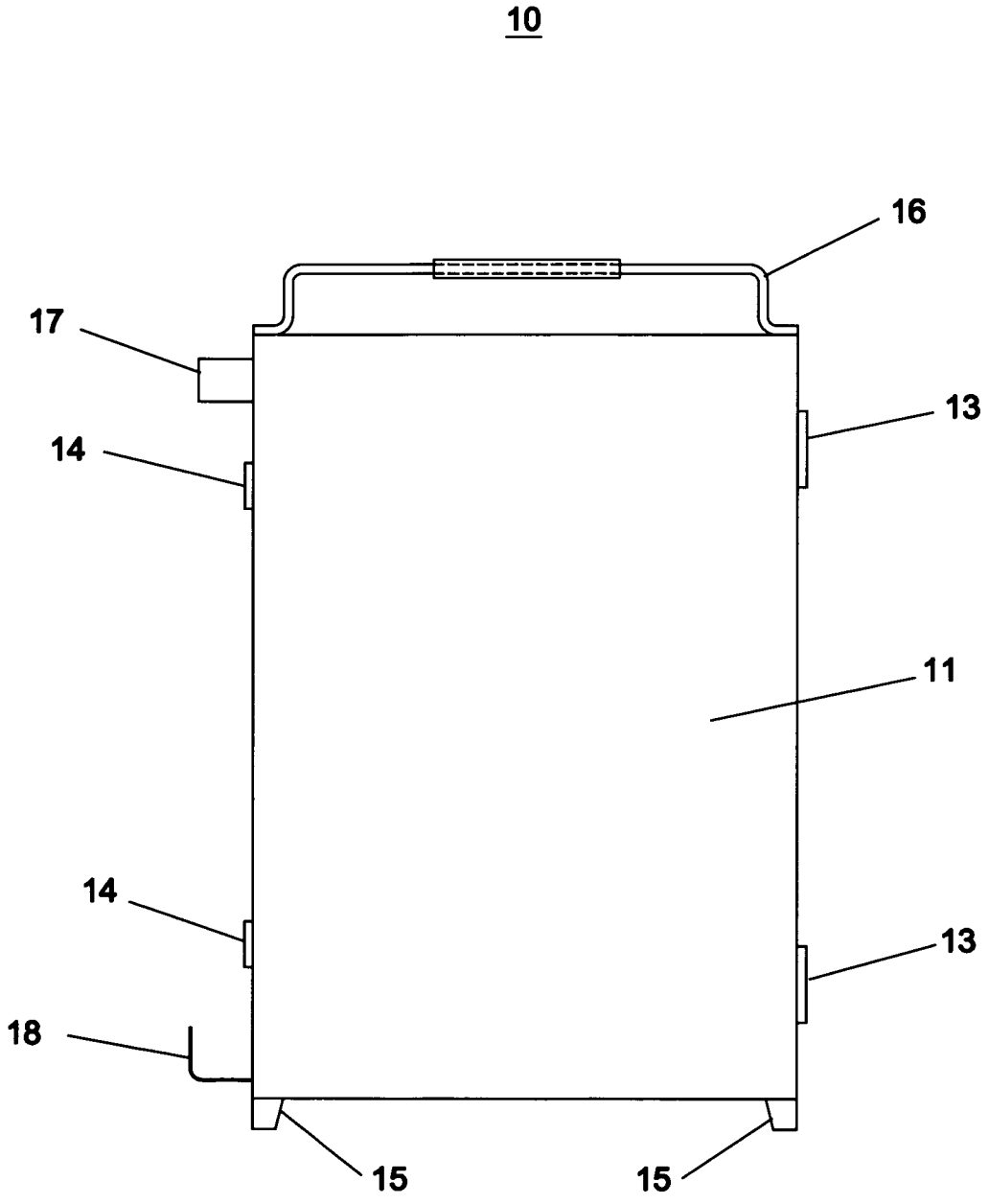
FIG. 2 is a schematic rear view of the tool box.

FIG. 2 as illustrated in this rear view, a multi function painter's tool box 10 includes a vertical oriented housing 11 which can be used for protecting, storing, transporting, cleaning and spin drying various painting tools. The door 12, in front of the box, is attached to the housing 11 with two hinges 13 on the left side of the door 12 allowing the door 12 open to the left. The door 12 has two latches 14 on the right side of the door 12, one part of the latch attached to the housing 11 and another part attached to the door 12, holding the door 12 closed when storing, transporting, cleaning and spin drying various painting tools. Four legs 15 are oriented in each corner of the tool box 10 elevating housing 11 off the surface allowing discharging water to escape from the box through the discharge holes 21. Carrying handle 16 on top is provided to carry the tool box 10. Paint roller extension pole holder embodiment include two clips 17 which are placed on top of the right side of the housing 11. The bottom part of the extension pole holder embodiment include a resting holder bracket 18 which is placed on bottom of the right side of the housing 11.

Figure 3:
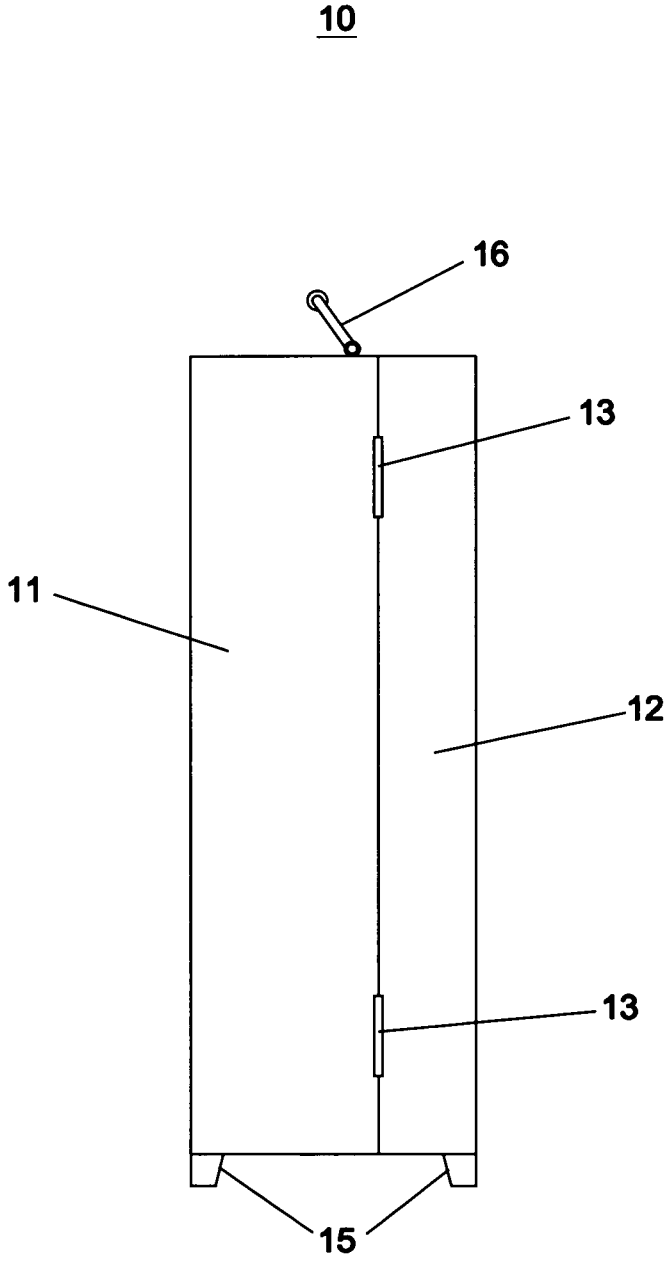
FIG. 3 is schematic left side view of the tool box.

FIG. 3 as illustrated in this left side view, a multi function painter's tool box 10 includes a vertical oriented housing 11 and the door 12 attached to the housing 11 with two hinges 13. Four legs 15 are oriented in each corner of the tool box 10 elevating housing 11 off the surface allowing discharging water to escape from the box through the discharge holes 21. Two of the four legs 15 are placed in the outer bottom corners of the housing 11 and two of them are placed on the outer corners of the door 12. The legs 15 on bottom of the door 12 stabilize the vertical tool box 10 when the door 12 is in open position. Carrying handle 16 on top is provided to carry the tool box 10.

Figure 4:
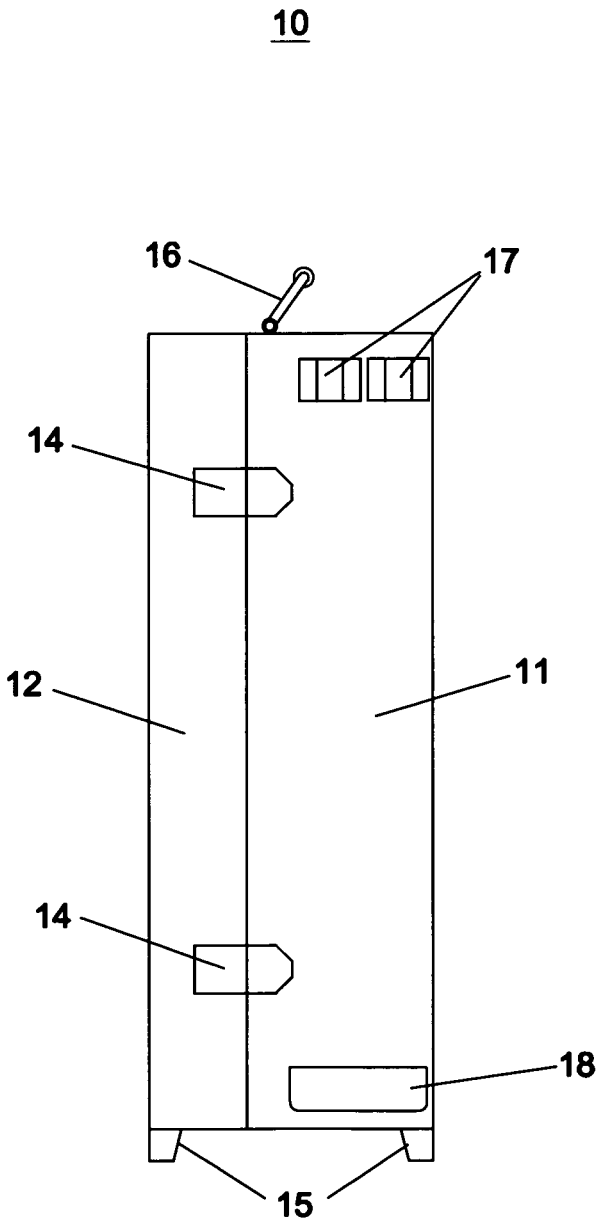
FIG. 4 is schematic right side view of the tool box.

FIG. 4 as illustrated in this right side view, a multi function painter's tool box 10 includes a vertical oriented housing 11 and the door 12 to access the tool box 10. The door 12 has two latches 14 on the right side of the door 12, one part of the latch 14 is attached to the housing 11 and another part is attached to the door 12, holding the door 12 closed when storing, transporting, cleaning and spin drying various painting tools. Four legs 15 are oriented in each corner of the tool box 10 elevating housing 12 off the surface allowing discharging water to escape from the box through the discharge holes 21. Two of the four legs 15 are placed in the outer bottom corners of the housing 11 and two of them are placed on the outer corners of the door 12. The legs 15 on bottom of the door 12 stabilize the vertical tool box 10 when the door 12 is on open position. Carrying handle 16 on top is provided to carry the tool box 10.

Figure 5:
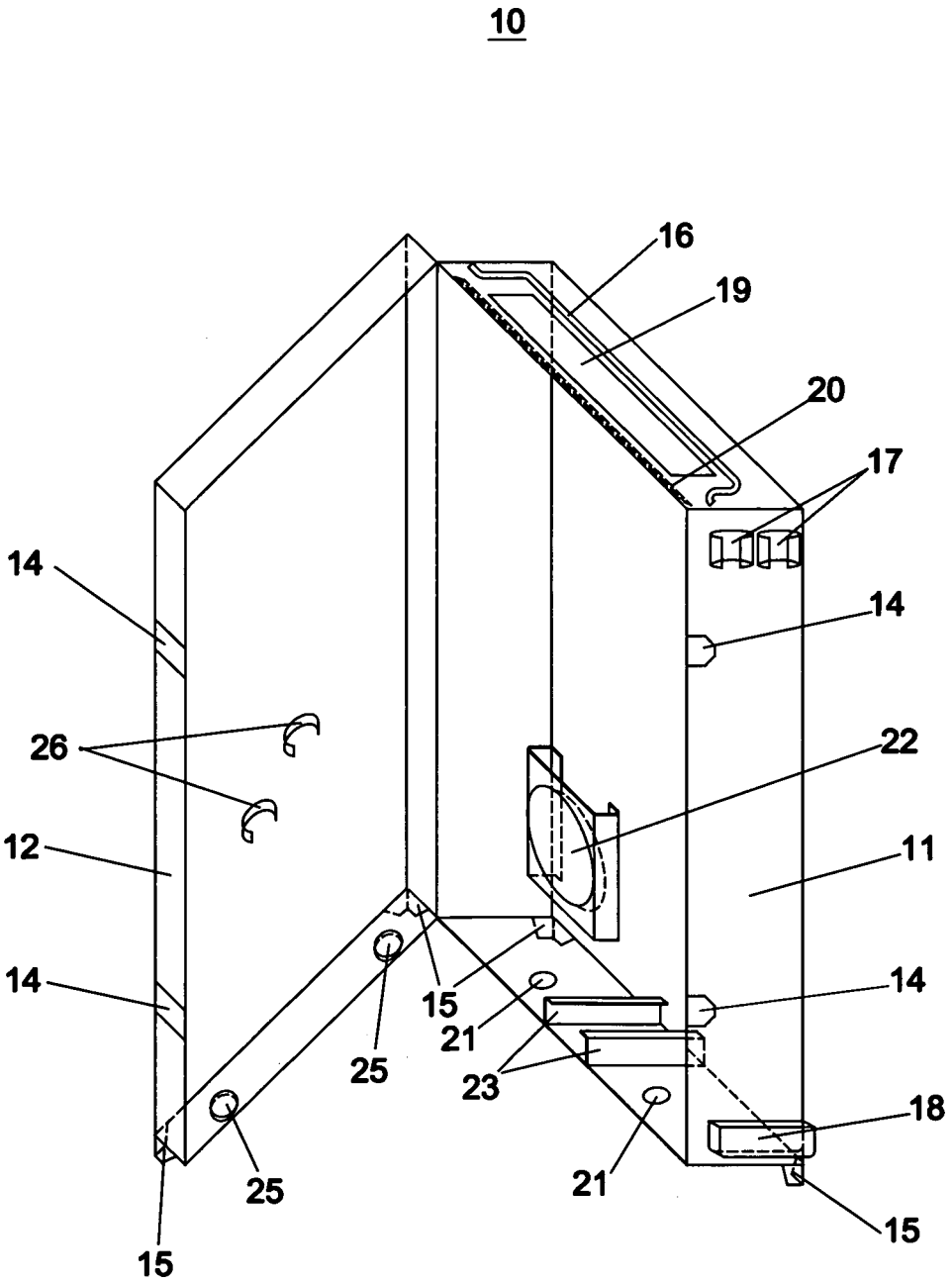
FIG. 5 is a somewhat schematic 3-D view of the tool box with the door open.

FIG. 5 is a somewhat schematic perspective view of the multi function painter's tool box 10 according to embodiment of the invention. This view comprises a various tool holders and features of this invention. On top of the housing 11 are carrying handle 16 and rectangular washing slot 19. Splash guard 20 is by the washing slot 19 inside the housing 11. Door latches 14, paint roller extension pole clips 17 and cradle 18 are attached to the right side of the housing 11. Bowl shaped paintbrush cleaning surface 22 is attached to the back wall inside the housing 11. Paint roller holder brackets 23, which are part of the paint roller holder assembly, are attached to the bottom of the housing 11. Two discharge holes 21 on the bottom, allow cleaning water and paint residue to discharge from the tool box 10 to the designated area. Four legs 15 on the bottom of the tool box 10 position the tool box 10 above the supporting surface allowing the cleaning water and paint residue to be discharged from the tool box 10 through the discharge holes 21 more easily. Two of the four legs are placed in the outer bottom corners of the housing and two of them are placed in the outer corners of the door. The legs on bottom of the door provide stability to the vertical tool box when the door is in open position as illustrated. The door 12 comprises two paintbrush holders 26 and two paint roller cover holders 25.

Figure 6:
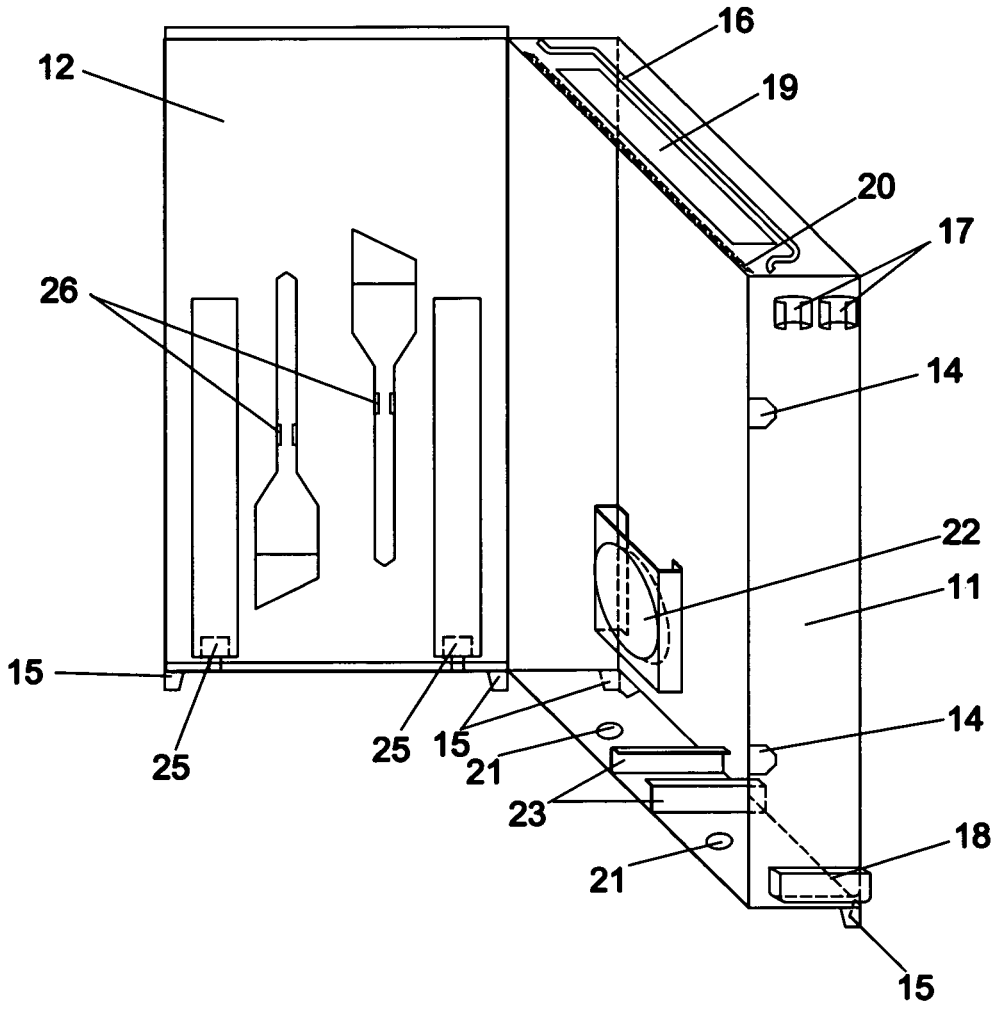
FIG. 6 is a somewhat schematic 3-Dview of the tool box with door open and tools on holders.

FIG. 6 is a somewhat schematic perspective view of the multi function painter's tool box 10 according to embodiment of the invention. This view comprises various painting tools placed on designated holders and features of this invention. On top of the housing 11 are carrying handle 16 and rectangular washing slot 19. Splash guard 20 is by the washing slot 19 inside the housing 11. Door latches 14, paint roller extension pole clips 17 and cradle 18 are attached to the right side of the housing 11. Bowl shaped paintbrush cleaning surface 22 is attached to the back wall inside the housing 11. Paint roller holder brackets 23, which are part of the paint roller holder assembly, are attached to the bottom of the housing 11. Two discharge holes 21 on the bottom, allow cleaning water and paint residue to discharge from the tool box 10 to the designated area. Four legs 15 on the bottom of the tool box 10 position the tool box 10 above the supporting surface allowing the cleaning water and paint residue to be discharged from the tool box 10 through the discharge holes 21 more easily. Two of the four legs are placed in the outer bottom corners of the housing and two of them are placed in the outer corners of the door. The legs on bottom of the door provide stability to the vertical tool box when the door is in open position as illustrated. The door 12 comprises two paintbrush holders 26 where two paintbrushes are attached and two paint roller cover holders 25 where two paint roller covers are attached.

Figure 7:
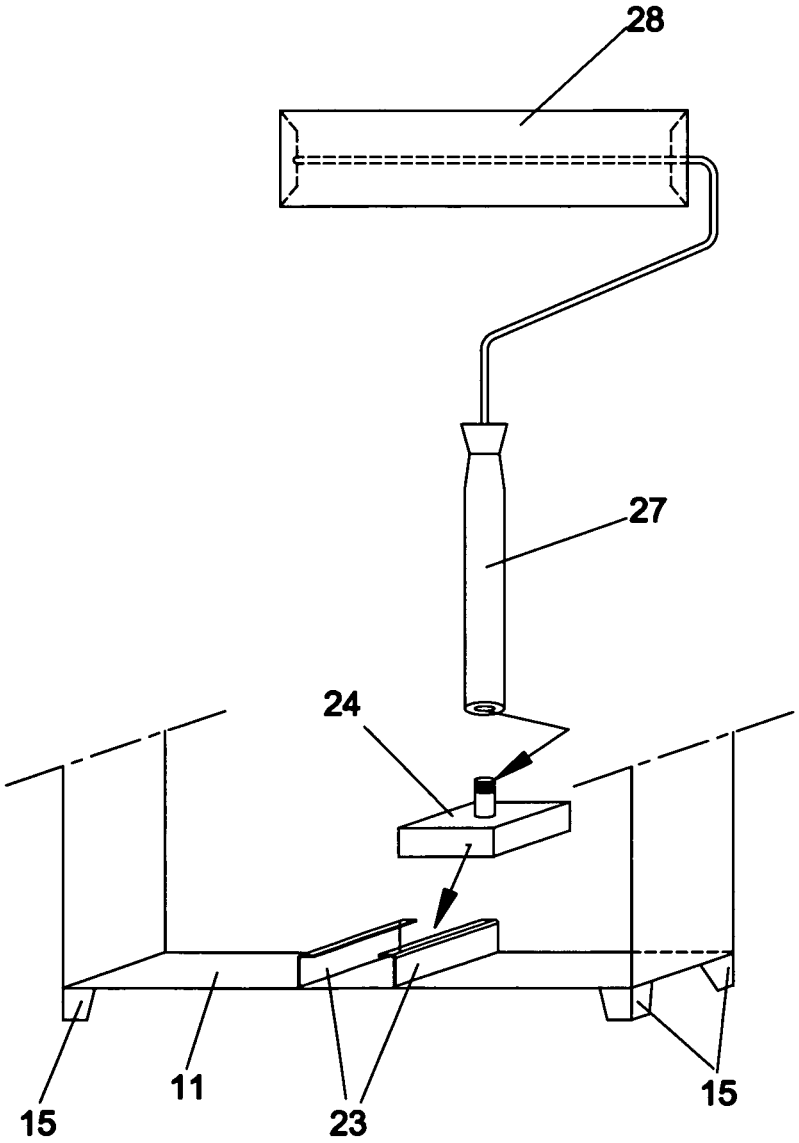
FIG. 7 is a schematic exploded view of the paint roller holder assembly.

FIG. 7 Provides a more detailed exploded view of a universal paint roller holder attachment mechanism. The attachment mechanism, is provided to receive and retain a paint roller handle in a desired position within the apparatus while storing and transporting and where the paint roller cover can be cleaned and spin dried from water soluble paints, include a universal paint roller handle 27 with a paint roller cover 28 attached, a universal paint roller handle holder 24 and a universal paint roller holder bracket 23 attached to the bottom of the housing 11.

Figure 8:
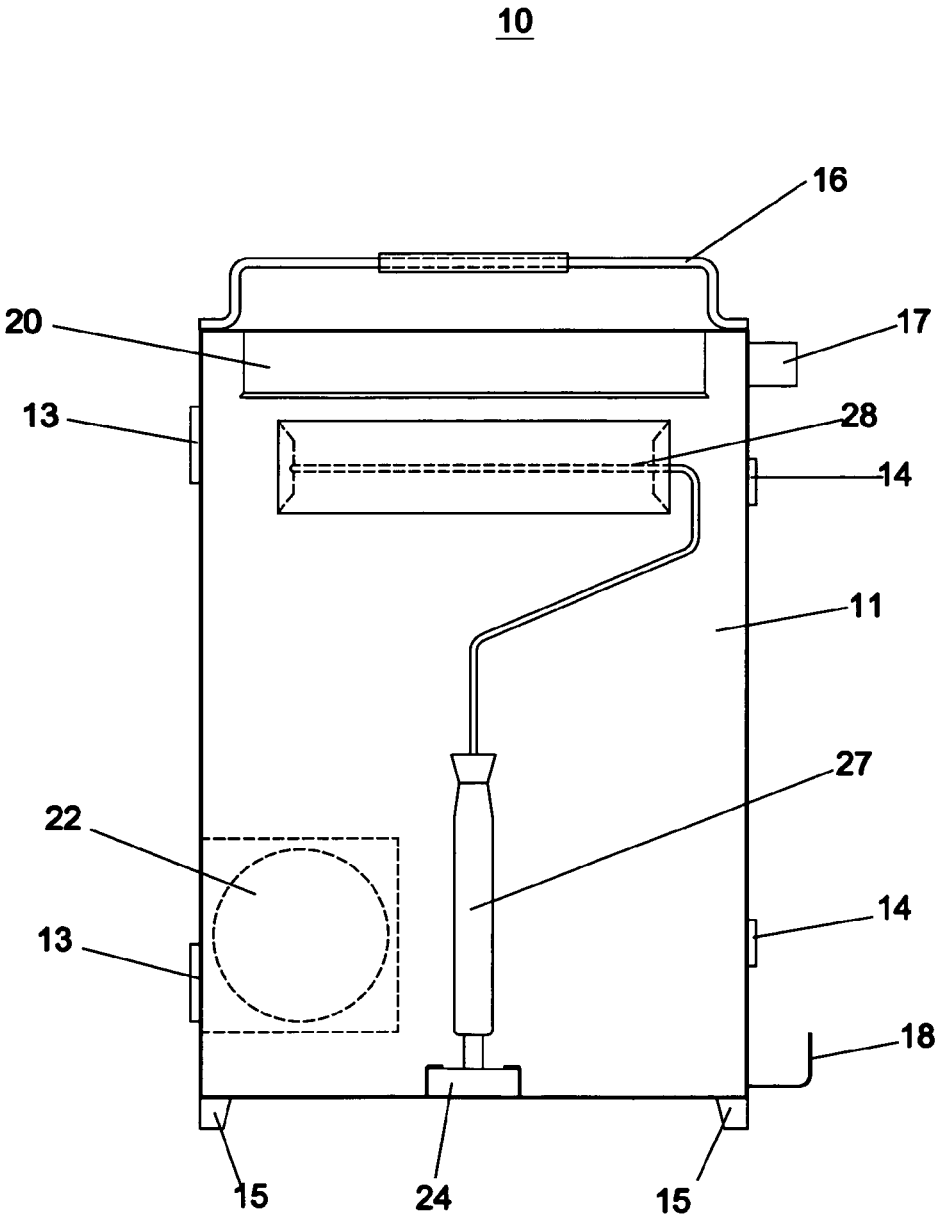
FIG. 8 is a schematic front view of the paint roller cover cleaning set up.

FIG. 8 provides a detailed view for one of the key features of this invention. As illustrated in this view, a universal paint roller handle attachment mechanism, as illustrated in FIG. 7, is provided to receive and retain a paint roller handle 27 in a desired position within the apparatus where the paint roller cover 28 can be cleaned and spin dried from water soluble paints and/or stains by using a garden hose or other flexible hose and household water pressure and generating a jet spray with a nozzle or restricting a flow otherwise and creating a jet spray, through the rectangular washing slot 19. The splash guard 20 beside the washing slot 19 is preventing water splashing out of the tool box 10 when cleaning the paint roller cover 28. The splashguard 20 is wider than the paint roller cover 28. It comprises a fold on the bottom collecting splashed water and discharging it on both ends away from the paint roller cover.

Figure 9:
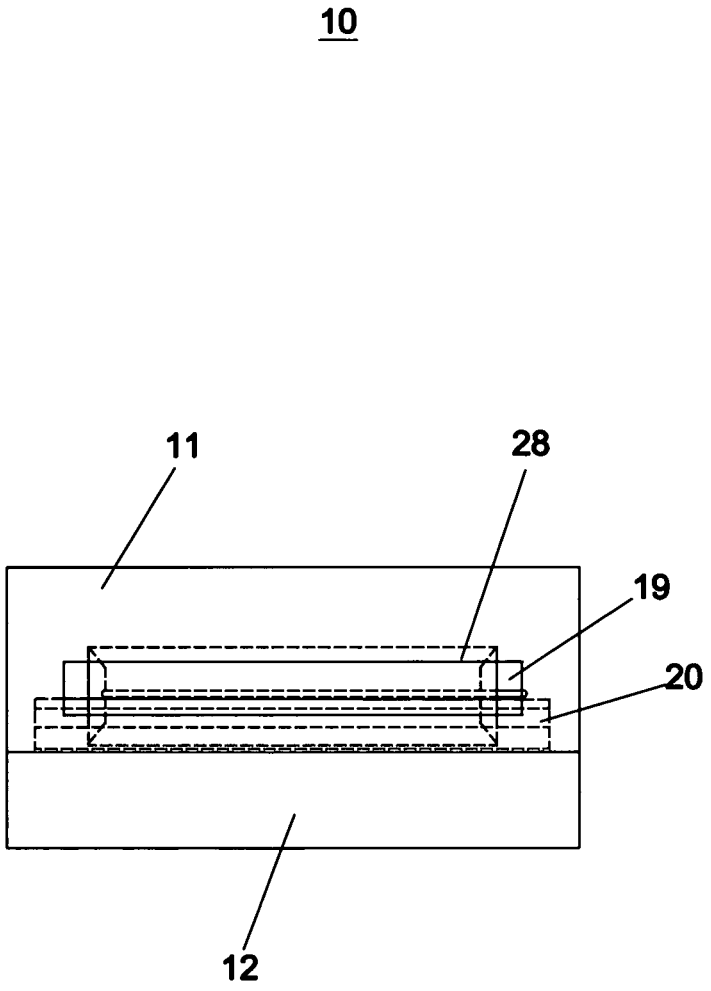
FIG. 9 is a schematic top view of the paint roller cover cleaning set up.

FIG. 9 provides a detailed view for one of the key features of this invention. As illustrated in this top view, only one half of the paint roller cover 28 is visible through the washing slot 19 when paint roller cover 28 remains attached to the universal paint roller handle 27 which remains attached to the universal paint roller attachment mechanism in the housing 11.

Figure 10:
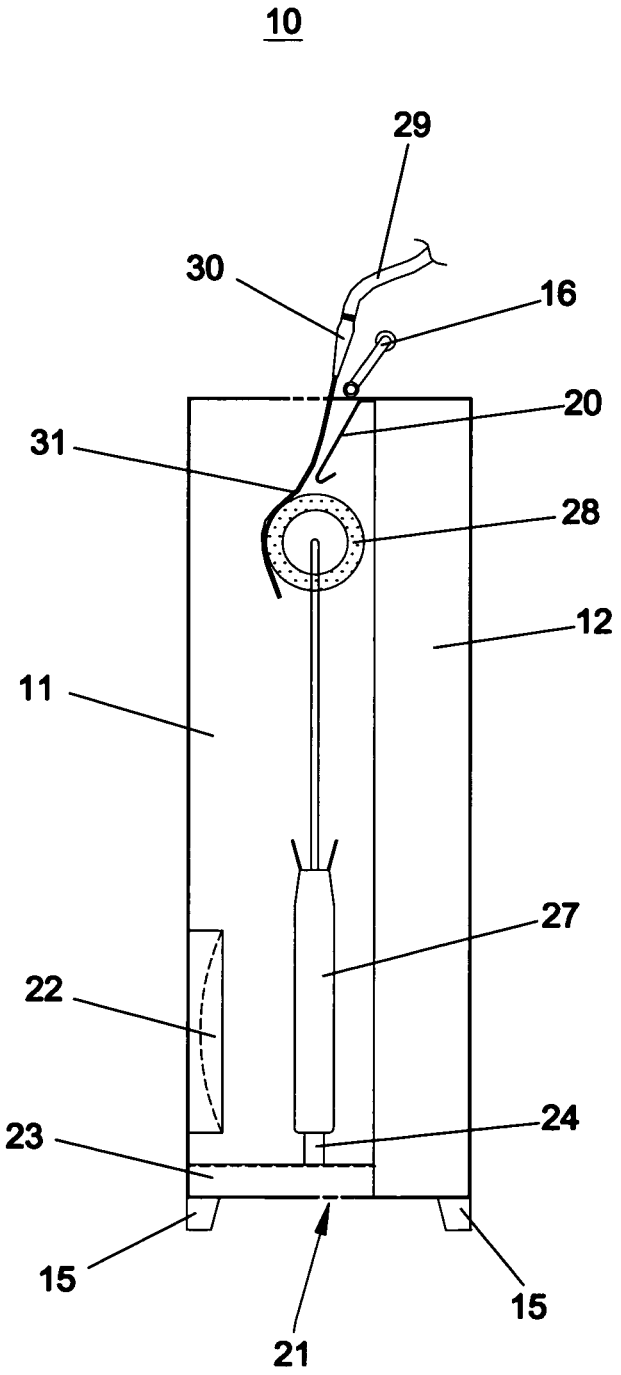
FIG. 10 is a schematic illustration of the paint roller cover cleaning procedure.

FIG. 10 provides a detailed view for the paint roller cleaning procedure. As illustrated in this view, a universal paint roller handle attachment mechanism, as illustrated in FIG. 7, is provided to receive and retain the paint roller handle 27 in a desired position within the apparatus where the paint roller cover 28 can be cleaned and spin dried from water soluble paints and/or stains by using a garden hose 29 or other flexible hose 29 and household water pressure and generating a jet spray 31 with a nozzle 30 or restricting a flow otherwise and creating a jet spray 31, through the rectangular washing slot 19, directing a jet spray 31 to a visible half of the paint roller cover through the washing slot, as illustrated in FIG. 9, using a free hand method and moving the jet spray 31 slowly from end to end of the paint roller cover 28, generating a high speed whirling motion to the paint roller cover 28, which is forcing the remaining paint in the paint roller cover 28 to the outer surface of the paint roller cover 28 where it is diluted by water and washed away. Only one half of the paint roller cover 28 is visible through the washing slot 19 when paint roller cover 28 remains attached to the universal paint roller handle 27 which remains attached to the universal paint roller attachment FIG. 7 mechanism in the housing 11. The splash guard 20 beside the washing slot 19 is preventing water splashing out of the tool box 10 when cleaning the paint roller cover 28. The splashguard 20 comprises a fold on the bottom collecting splashed water and discharging it on both ends away from the paint roller cover 28.

Figure 11:
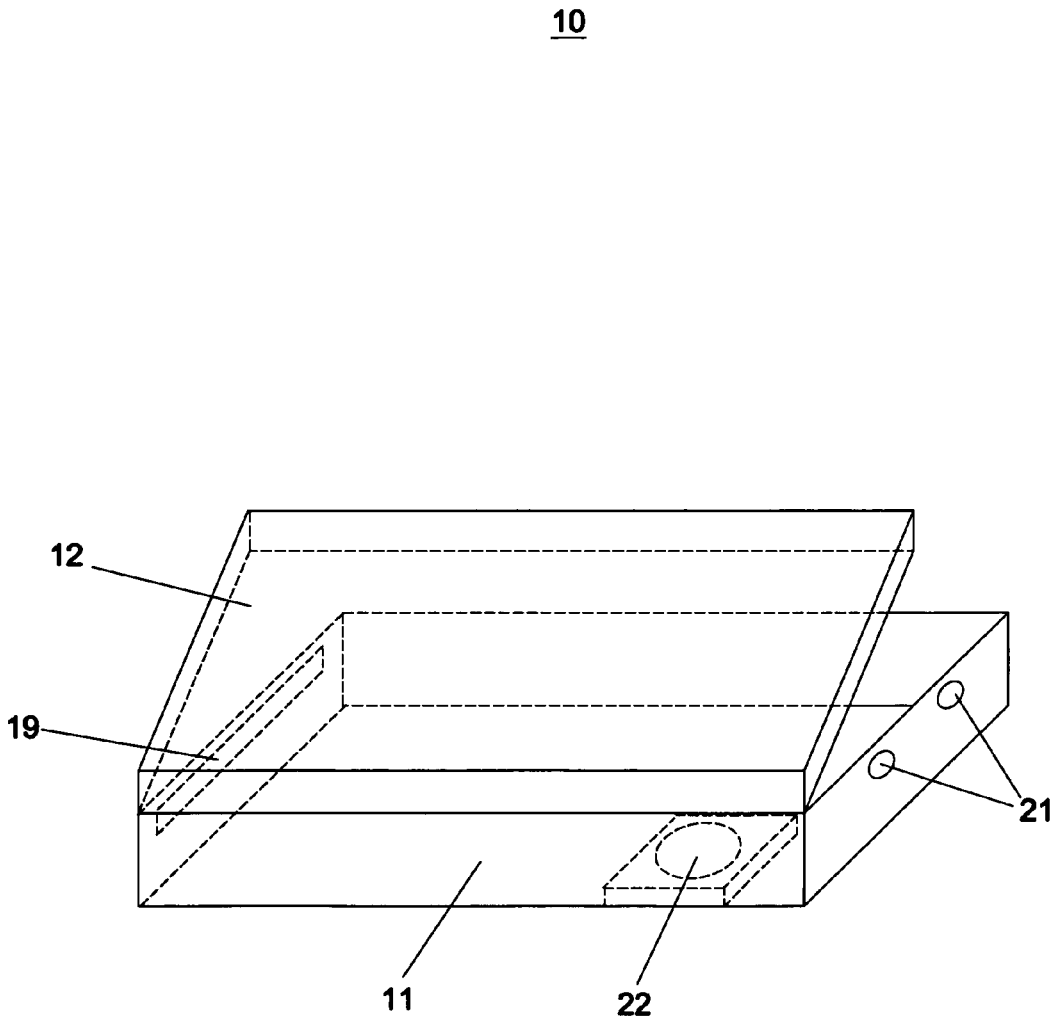
FIG. 11 is a schematic view of the paintbrush cleaning set up.

FIG. 11 provides a detailed view for one of the key features of this invention. As illustrated in this view, the housing 11 comprises a paint brush cleaning surface 22 attached to the back wall. The housing 11 must be vertically oriented when using this paint brush cleaning surface 22 for paintbrush cleaning.

Figure 12:
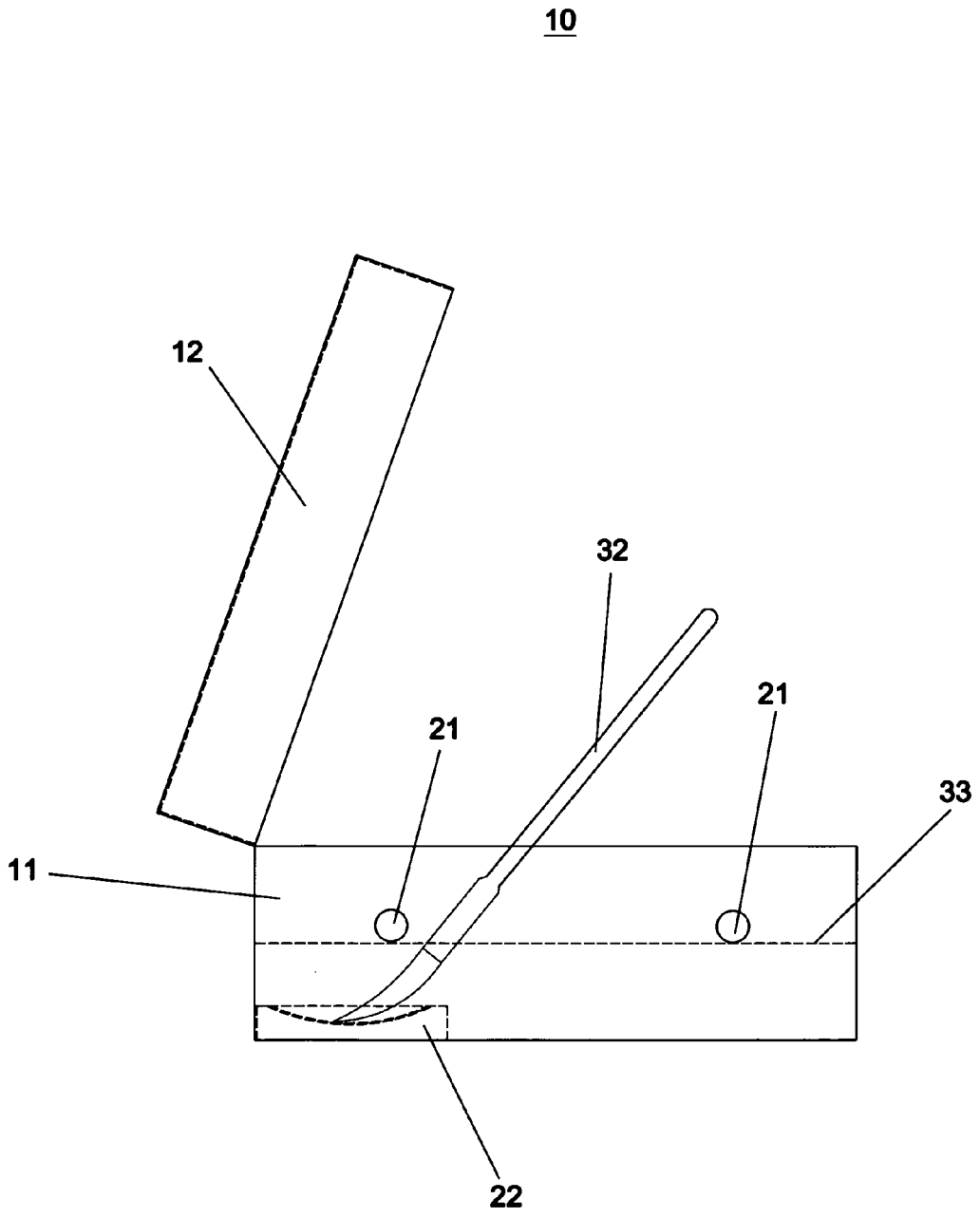
FIG. 12 is a schematic illustration of the paintbrush cleaning procedure.

FIG. 12 provides a detailed view for the paintbrush cleaning procedure. As illustrated in this view, the vertically oriented housing 11 is filled with water up to the strategically located discharge holes 21 and washing slot 19 level to provide a sufficient water level in the housing 11 for paintbrush 32 cleaning. When sufficient water level is reached in the housing 11 the paintbrush 32 can be cleaned from water soluble paints and/or stains by bending bristles to a same direction and vigorously pressing against the cleaning surface 22 under the water. Slightly bowl shaped paintbrush cleaning surface 22 is directing the water to the center of the paintbrush 32 forcing the remaining out of the paintbrush 32.

What is claimed is:

1. A multifunction device for cleaning and spin drying a paint roller cover from water soluble paints, for cleaning a paint brush from water soluble paints, and for storing painting tools, said device comprising:

a vertically oriented enclosure supported by four leg members, said enclosure comprising:

a back wall;

a front wall;

a first side wall;

a second side wall;

a top wall; and a bottom wall;

wherein a vertical line of division runs parallel with said front and back walls of said enclosure thereby dividing said enclosure into a front section defining a door and a back section defining a housing, said housing comprising said back wall and a portion of each of said first side wall, said second side wall, said top wall and said bottom wall extending outwardly away from said back wall towards said front wall, said door comprising said front wall and a portion of each of said first side wall, said second side wall, said top wall and said bottom wall extending outwardly away from said front wall towards said back wall, said door being hingedly connected to said housing and secured in a closed position with latches;

at least one discharging hole on said bottom wall portion of said housing;

a rectangular washing opening on said top wall portion of said housing;

a splash guard inside said housing by said washing opening;

a carrying handle;

a paint roller holder assembly;

a paint brush cleaning surface; and at least one painting tool holder.

2. The device of claim 1, wherein said door is hingedly connected to said housing with hinges, said hinges being attached to a first side of said door and to a first side of said housing such that said door can traverse between an opened position and the closed position; and wherein said latches are attached to a second side of said door and to a second side of said housing to secure said door in said closed position.

3. The device of claim 1, wherein said at least one painting tool holder includes at least one paint brush holder, at least one paint roller cover holder and at least one paint roller extension pole holder.

4. The device of claim 1, wherein said washing opening extends parallel to said front and back walls of said enclosure.

5. The device of claim 1, wherein said at least one discharging hole allows the escape of washing fluid from the device when in the closed position.

6. The device of claim 1, wherein said leg members project downward from said bottom wall, said leg members raising the enclosure from a supporting surface for allowing the escape of washing fluid from said device through said at least one discharging hole; and wherein two of said leg members are placed on outer bottom corners of said housing and two of said leg members are placed on outer bottom corners of said door thereby providing stability when said door is in an open position.

7. The device of claim 1, wherein said carrying handle is pivotally attached on said top wall portion of said housing.

8. The device of claim 1, wherein said paint roller holder assembly comprises a paint roller holder bracket and a paint roller holder, said paint roller holder bracket is fixed to said bottom wall portion of said housing, said paint roller holder is removably inserted into said paint roller holder bracket such that said paint roller holder positioning can be adjusted.

9. The device of claim 1, wherein said paint brush cleaning surface is slightly bowl shaped and mounted to a bottom corner of said back wall.

10. The device of claim 1, wherein a positioning of said at least one discharging hole and said washing opening allow a sufficient water level in said housing for cleaning said paint brush by using said paint brush cleaning surface.

11. The device of claim 1, wherein the housing is dimensioned to enable cleaning of a paint roller with an attached 240 mm standard roller cover.

12. The device of claim 1, wherein said splash guard comprises a fold on the bottom for collecting splashed water and discharging it on ends of the splash guard away from a paint roller cover being cleaned.

* * * * *